US005151465A

United States Patent [19]

Le-Khac

[11] Patent Number: 5,151,465

[45] Date of Patent: Sep. 29, 1992

[54] POLYMER COMPOSITIONS AND ABSORBENT FIBERS PRODUCED THEREFROM

[75] Inventor: Bi Le-Khac, West Chester, Pa.

[73] Assignee: ARCO Chemical Technology, L.P., Wilmington, Del.

[21] Appl. No.: 678,481

[22] Filed: Apr. 1, 1991

Related U.S. Application Data

[62] Division of Ser. No. 460,681, Jan. 4, 1990.

[51] Int. Cl.[5] ..... L08L 31/02

[52] U.S. Cl. ..... 524/549; 524/556

[58] Field of Search ..... 524/549, 556

[56] References Cited

U.S. PATENT DOCUMENTS

| | | | |
|---|---|---|---|
| 3,669,103 | 6/1972 | Harper et al. | 128/156 |
| 3,678,016 | 7/1972 | Zimmerman et al. | 260/78.4 D |
| 3,954,721 | 5/1976 | Gross | 526/14 |
| 3,980,663 | 9/1976 | Gross | 260/29.6 TA |
| 3,989,586 | 11/1976 | Bashaw et al. | 162/168 N |
| 3,993,616 | 11/1976 | Gross | 260/29.4 UA |
| 4,056,502 | 11/1977 | Gross | 260/29.6 N |
| 4,155,957 | 5/1979 | Sasayama | 260/897 B |
| 4,211,851 | 7/1980 | Sasayama | 525/108 |
| 4,332,917 | 6/1982 | Heslinga et al. | 521/134 |
| 4,338,417 | 7/1982 | Heslinga et al. | 525/197 |
| 4,389,513 | 6/1983 | Miyazaki | 525/186 |
| 4,418,163 | 11/1983 | Murakami et al. | 523/205 |
| 4,420,588 | 12/1983 | Yoshioka et al. | 525/93 |
| 4,616,063 | 10/1986 | Le-Khac | 525/91 |
| 4,705,773 | 11/1987 | Le-Khac | 502/402 |
| 4,731,067 | 3/1988 | Le-Khac | 604/367 |
| 4,743,244 | 5/1988 | Le-Khac | 604/376 |
| 4,813,945 | 3/1989 | Le-Khac | 604/367 |
| 4,880,868 | 11/1989 | Le-Khac | 524/549 |

FOREIGN PATENT DOCUMENTS

| | | |
|---|---|---|
| 0268498 | 5/1988 | European Pat. Off. . |
| 0269393 | 6/1988 | European Pat. Off. . |
| 2627708 | 6/1976 | Fed. Rep. of Germany . |
| 2891288 | 2/1988 | Japan . |

*Primary Examiner*—Bernard Lipman
*Attorney, Agent, or Firm*—Dennis M. Kozak

[57] ABSTRACT

Aqueous, uncured but curable, polymer compositions which are stable at room temperature and possess excellent shelf life in uncured form are disclosed. The uncured polymer compositions can be made into fibers using conventional fiber forming processes and cured to produce absorbent fibers capable of absorbing at least 60 times their weight of brine.

22 Claims, No Drawings

POLYMER COMPOSITIONS AND ABSORBENT FIBERS PRODUCED THEREFROM

This is a division of application Ser. No. 07/460,681, filed Jan. 4, 1990.

This invention relates to curable polymer compositions which, when cured, become highly water absorbent.

More specifically, this invention relates to aqueous uncured linear polymer compositions which are stable at room temperature and possess excellent shelf life in uncured form. Because of their excellent shelf life, the compositions can be made into fibers which become highly water absorbent when cured.

In one of its more specific aspects, this invention relates to highly absorbent fibers and fiber products suitable for use in the manufacture of conventional hygienic and household absorbent products. The fibers of this invention achieve uniformly consistent, highly absorbent properties using small amounts of a reactive cross-linking compound and require short cure times.

The terms "absorbent," "water-absorbing," and "water-absorbent" when used herein to modify the polymer compositions, fibers, or fiber products of this invention are meant to include water, brine, and electrolyte solutions such as body fluids.

Absorbent polymers in powder form are widely used in hygienic and household products. Examples of such products include surgical and dental sponges, tampons, sanitary napkins and pads, bandages, disposable diapers, disposable towels, incontinence products, meat tray pads, household pet litter, and the like. Absorbent polymers are also used as soil conditioners to improve water retention and increase air capacity and as water stopping agents for cables and the like.

Although many of the commercial absorbent powders exhibit good water-absorbing capacity, they are hard to incorporate into absorbent products (e.g., disposable diapers) because of powder dusting problems and their tendency to move from where are placed. Special powder handling equipment is generally required, and the powder must be glued, fused, or laminated to a support structure to keep the powder in place. These additional handling and manufacturing steps are time-consuming and increase manufacturing and product costs. In addition, powders form gels that have little integrity or gel strength, and because of this, they are difficult to contain within a support structure. The containment of an absorbent material and the gel it forms upon absorbent usage is a critical property of disposable products.

The above deficiencies in absorbent powders have led the absorbent product industry to seek non-powder forms of absorbent resins, specifically fibers. There remains a need in the absorbent product industry for an absorbent fiber which possesses uniformly consistent absorbent properties and can be made reliably at high speed and in large volume, using, to the extent possible, conventional spinning technology. It is obvious that the industry also desires higher absorbing fibers.

One recent approach suitable for producing absorbent powders but not fibers is found in U.S. Pat. No. 4,418,163. This patent teaches a highly absorbent resin obtained by adding a polyamine to the reaction product of an isobutylene-maleic anhydride copolymer with an alkali metal hydroxide. Cross-linking is achieved by ionic bonds between the carboxyl groups and the polyamine which bonds form immediately and at room temperature. The ionic bonds are converted to amide linkage by dehydration, resulting in an absorbent resin. Due to the immediate ionic bond-forming reaction which serves to insolubilize the polymer, further processing of the resin into fibers is not feasible. Cross-linking agents other than polyamines are disclosed, including polyhydric alcohols and amino-alcohols, but the patent further teaches that if a cross-linking agent other than a polyamine is used, cross-linking is then effected by linkages which are liable to hydrolysis, resulting in very poor water-absorbing composites. U.S. Pat. No. 4,418,163, is not seeking to produce fibers and fails to recognize that the key to producing absorbent fibers lies in the use of different cross-linking chemistry. Moreover, the very benefit sought and achieved by using a polyamine in the patent leads away from fiber manufacture.

U.S. Pat. Nos. 4,731,067 and 4,880,868 to Bi Le-Khac teach that blends of partially neutralized isobutylene-maleic anhydride copolymers and non-reactive compounds can be made into absorbent fibers. More specifically, Le-Khac discovered that blends of a diol or glycol with a partially neutralized isobutylene-maleic anhydride copolymer are stable at room temperature, can be stored for long periods of time, and facilitate fiber spinning on conventional spinning equipment. Fiber spinning of Le-Khac's blends is possible because cross-linking is effected only through ester linkages which do not form at room temperature, giving the blends excellent stability and shelf life.

Notwithstanding the significance of Le-Khac's discovery that cross-linking through ester linkages results in a stable, uncured but heat curable syrup which can be spun into fibers using conventional dry spinning techniques, the resulting fibers have met with limited commercial success. The limited commercial success is due to the fact that the absorbent properties of the fibers are extremely difficult to control; there is considerable absorbency variation between fibers and among fiber runs. This difficulty in controlling the absorbent properties of the fibers is due in large part to the fact that in order to achieve cross-linking cure times of about thirty minutes and obtain a fiber that absorbs 40–50 times its weight of brine, it is necessary to add considerably more diol or glycol than is theoretically needed to achieve cross-linking. The addition of excess amounts of diol or glycol are necessary because during processing, i.e., spinning of the blend, large amounts of the non-reactive diol or glycol are washed out of the blend or tend to migrate to the fiber surface and do not effect cross-linking. In other words, extra diol or glycol must be added to ensure that sufficient amounts are present to achieve cross-linking of the resultant fibers. Because of the excess amount and uncertain location of non-reactive compound in the fiber and on the fiber surface, absorbency properties of the fibers are difficult to control and tend to vary considerably. Obtaining optimal curing and consistent absorbency is pretty much by trial and error.

A substantial amount of additional effort has gone into understanding the cross-linking problems exhibited by the fibers of the above-mentioned patents and has led to the discovery of not only the reasons for the problems but also to the present invention, which provides a solution to those problems. The present invention facilitates the production of absorbent fibers using conventional spinning equipment, requires considerably less cross-linking agent, shorter cure times, and yields absorbent fibers having uniformly consistent absorbency properties. Quite surprisingly, the absorbent fibers of this invention possess much better absorbent properties as compared to the prior art fibers.

According to this invention, there is provided a fiberizable, aqueous, uncured but curable, polymer composition comprising the reaction product of:

(a) a partially neutralized aqueous polymer composition prepared by the reaction of a strong base with a polymer containing at least 25 mole percent recurring units of an $\alpha,\beta$-unsaturated monomer having in its molecule one or two carboxyl groups or one or two other groups convertible to carboxyl groups, the degree of neutralization of said partially neutralized polymer being within the range of from about 0.2 to about 0.8 equivalent of total carboxyl groups or groups convertible to carboxyl groups of the $\alpha,\beta$-unsaturated monomer, with (b) from about 0.1 to about 10 total parts by weight of at least one reactive compound per 100 parts by weight of the partially neutralized aqueous polymer, the reactive compound being a water soluble compound bearing one amine group and at least one hydroxyl group, wherein the reaction product is formed by substituted ammonium carboxylate ionic bonding between the unneutralized carboxyl groups on the polymer and the amine groups on the reactive compound.

Also according to this invention, there is provided a method for making absorbent fibers which comprises:

(a) attenuating a partially neutralized, aqueous, uncured polymer composition prepared by reacting a strong base with a polymer containing at least 25 mole percent recurring units of an $\alpha,\beta$-unsaturated monomer having in its molecule one or two carboxyl groups or one or two other groups convertible to carboxyl groups, the degree of neutralization of said partially neutralized polymer being within the range of from about 0.2 to about 0.8 equivalent of total carboxyl groups or groups convertible to carboxyl groups of the $\alpha,\beta$-unsaturated monomer, with from about 0.1 to about 10 total parts by weight of at least one reactive compound per 100 parts by weight of the partially neutralized polymer, the reactive compound being a water soluble compound bearing one amine group and at least one hydroxyl group, and (b) heating the fibers to cure and render them absorbent by removing water and cross-linking through both ester and amide linkages.

According to this invention, there is also provided an absorbent fiber which is the cured attenuated reaction product of:

(a) a partially neutralized, aqueous, uncured polymer composition prepared by reacting a strong base with a polymer containing at least 25 mole percent recurring units of an $\alpha,\beta$-unsaturated monomer having in its molecule one or two carboxyl groups or one or two other groups convertible to carboxyl groups, the degree of neutralization of said partially neutralized polymer being within the range of from about 0.2 to about 0.8 equivalent of total carboxyl groups or groups convertible to carboxyl groups of the $\alpha,\beta$-unsaturated monomer, with (b) from about 0.1 to about 10 total parts by weight of at least one reactive compound per 100 parts by weight of the partially neutralized polymer, the reactive compound being a water soluble compound bearing one amine group and at least one hydroxyl group.

In a preferred embodiment, cured fibers of this invention are capable of absorbing at least 60, preferably at least 70, and most preferably at least 80, times their weight in brine (0.9 wt. % NaCl) and are produced using from about 0.1 to about 10, preferably from about 0.5 to about 6, and most preferably from about 1 to about 5, parts by weight of reactive compound and cure conditions within the following ranges: cure temperature, 140°-210° C.; cure time, less than about 15, preferably less than about 12, minutes. The examples which follow below demonstrate several fibers which fall within the preferred embodiment.

The partially neutralized polymer employed in this invention is prepared using a polymer containing at least 25 mole percent recurring units of $\alpha,\beta$-unsaturated monomer. The polymer may be a homopolymer or a copolymer, in which case it will contain in mole percent from about 25 to about 75 mole percent of at least one $\alpha,\beta$-unsaturated monomer and from about 75 to about 25 recurring units of at least one copolymerizable monomer.

Any $\alpha,\beta$-unsaturated monomer having in its molecule one or two carboxyl groups or one or two other groups which can be converted into carboxyl groups by hydrolysis or acidification is suitable for use.

Particularly suitable $\alpha,\beta$-unsaturated monomers for use to produce homopolymers usable to produce the partially neutralized polymer include acrylic acid and methacrylic acid.

Particularly suitable $\alpha,\beta$-unsaturated monomers for use to produce copolymers usable in this invention include those which bear one or two carboxyl groups or groups convertible to carboxyl groups, such as carboxylic acid salt groups, carboxylic acid amide groups, carboxylic acid imide groups, carboxylic acid anhydride groups, and carboxylic acid ester groups.

Examples of suitable $\alpha,\beta$-unsaturated monomers are maleic acid, crotonic acid, fumaric acid, mesaconic acid, the sodium salt of maleic acid, the sodium salt of 2-methyl,2-butene dicarboxylic acid, the sodium salt of itaconic acid, maleamic acid, maleamide, N-phenylmaleimide, maleimide, maleic anhydride, fumeric anhydride, itaconic anhydride, citraconic anhydride, mesaconic anhydride, methyl itaconic anhydride, ethyl maleic anhydride, diethylmaleate, methylmaleate, and the like, and their mixtures.

Suitable copolymerizable monomers for use to produce partially neutralized copolymers used in this invention can be readily selected by one skilled in the art. Of course, a copolymerizable monomer which does not negatively affect the absorbent properties of the cured reaction product should be selected.

Suitable copolymerizable monomers include $\alpha$-olefins, vinyl monomers, and vinylidene monomers. Examples of suitable monomers include: ethylene, propylene, isobutylene, 1-butylene, $C_1$ to $C_4$ alkyl methacrylates, vinyl acetate, methyl vinyl ether, isobutyl vinyl ether, and styrenic compounds having the formula:

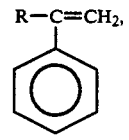

wherein R represents hydrogen or an alkyl group having from 1 to 6 carbon atoms and wherein the benzene ring may be substituted with low molecular weight alkyl or hydroxy groups.

Suitable $C_1$ to $C_4$ alkyl acrylates include methyl acrylate, ethyl acrylate, isopropyl acrylate, n-propyl acrylate, n-butyl acrylate, and the like, and their mixtures.

Suitable $C_1$ to $C_4$ alkyl methacrylates include methylmethacrylate, ethyl methacrylate, isopropyl methacrylate, n-propylmethacrylate, n-butyl methacrylate, and the like, and their mixtures.

Suitable styrenic compounds include styrene, α-methylstyrene, p-methylstyrene, t-butyl styrene, and the like, and their mixtures.

If a copolymer (understood to include terpolymers, etc.) rather than a homopolymer is employed in the practice of this invention, it will contain in mole percent from about 25 to about 75 recurring units of at least one α,β-unsaturated monomer and from about 75 to about 25 recurring units of at least one copolymerizable monomer. Preferably, the copolymer will contain from about 35 to about 65 mole percent recurring units of at least one α,β-unsaturated monomer and from about 65 to about 35 total mole percent of at least one copolymerizable monomer. Most preferably, the copolymer used in the invention will be an equimolar copolymer. Copolymers are preferred in the practice of this invention.

Examples of polymers usable in the practice of this invention include: α-olefin/maleic anhydride copolymers, α-olefin/citraconic anhydride copolymers, -olefin/acrylic acid copolymers, α-olefin/methacrylic acid copolymers, vinyl compound/maleic anhydride copolymers, vinyl compound/citraconic anhydride copolymers, vinyl compound/acrylic acid copolymers, vinyl compound methacrylic acid copolymers, alkyl acrylate/maleic anhydride copolymers, alkyl acrylate/citraconic anhydride copolymers, alkyl vinyl ether/maleic anhydride copolymers, alkyl vinyl ether/citraconic anhydride copolymers, vinyl acetate/maleic anhydride copolymers, α-olefin/maleic anhydride/α-olefin terpolymers, polyacrylic acid, polymethacrylic acid, and the like, and their mixtures.

One polymer particularly suitable for use in this invention is a copolymer of isobutylene and maleic anhydride. Another is styrene and maleic anhydride. Suitable polymers will have peak molecular weights of from about 5,000 to about 500,000 or higher.

Copolymers of isobutylene and maleic anhydride can be prepared using any suitable conventional method but are also commercially available from Kuraray Isoprene Chemical Company, Ltd., Tokyo, Japan, under the trademark ISOBAM. ISOBAM copolymers are available in several grades which are differentiated by viscosity molecular weight: ISOBAM-18, 290,000 to 310,000; ISOBAM-10, 160,000 to 170,000; ISOBAM-06, 80,000 to 90,000; ISOBAM-04, 55,000 to 65,000; and ISOBAM-600, 6,000 to 10,000. ISOBAM-18 and ISOBAM-10 are the preferred copolymers.

As discussed above, an α,β-unsaturated monomer which contains one or two groups convertible to the required carboxyl groups may be used, but conversion typically involves an additional hydrolysis or acidification step.

For example, if the α,β-unsaturated monomer bears only carboxylic acid amide, carboxylic acid imide, carboxylic acid anhydride, carboxylic acid ester groups, or mixtures thereof, it will be necessary to convert at least a portion of such carboxylic acid derivative groups to carboxylic acid groups by, for example, a hydrolysis reaction. If an isobutylene/maleic anhydride copolymer is selected for use, upon the formation of an aqueous composition, a ring-opening hydrolysis reaction occurs which provides a pendant carboxyl group.

The neutralization reaction to produce the partially neutralized polymer used in this invention is carried out using any suitable strong organic or inorganic base. Suitable bases include alkali metal hydroxides, ammonium hydroxides, and substituted ammonium hydroxides. Alkali metal hydroxides such as potassium hydroxide and sodium hydroxide are preferred.

The neutralization reaction is carried out in water to obtain a partially neutralized polymer, the degree of neutralization of the polymer being within the range of from about 0.2 to about 0.8, preferably 0.3 to 0.7, equivalent of total carboxyl groups of the α,β-unsaturated monomer.

In the practice of this invention, the partially neutralized polymer is then reacted with from about 0.1 to about 10 or more, preferably from about 0.5 to about 6, and most preferably from about 1 to about 5, parts by weight of a reactive compound selected to have one amine group and at least one, preferably two, hydroxyl groups per 100 parts by weight of partially neutralized polymer. Using more than 10 parts of reactive compounds, although possible, provides no advantage in this invention. Moreover, it is desirable to use as little reactive compound as possible sufficient to achieve cross-linking.

Suitable water-soluble reactive compounds include: ethanolamine, tris(hydroxymethyl)aminomethane, 3-amino-1-propanol, DL-1-amino-2-propanol, 2-amino-1-butanol, N,N-dimethylethanolamine, diisopropanolamine, methyldiethanolamine, triethanol amine, 2-(methylamino)ethanol, and the like, and their mixtures. Tris(hydroxymethyl)aminomethane is preferred.

The water-soluble reactive compound bearing one amine and at least one hydroxyl group serves as a high temperature, slow-reacting, two-step cross-linking agent for the partially neutralized polymer. The amine groups react first to tie or graft the reactive compound onto the partially neutralized polymer via fast-reacting ammonium salt formations between the amine and the pendant carboxylic acid units on the polymer. At this point, the partially neutralized polymer reaction product is still linear and possess excellent shelf life stability and processability. It is not cured, and hence, not absorbent, at this point and can be fabricated into any desired form for absorbent usage, such as fibers. The resultant ionic bonds are sufficient to keep the reactive compound from migrating to the fiber surface or washing out during fiber processing; thus, there is no need to employ the reactive compound in excess. All of the reactive compound remains available for the cross-linking reaction.

The second stage reaction between the reactive compound and the polymer is the curing or cross-linking reaction. This cross-linking reaction will not occur and the product will not become absorbent until the partially neutralized polymer reaction product, bearing grafted reactive compound, is heated to a temperature sufficient to (i) remove water and form ester linkages between the hydroxyl groups of the reactive compound and the carboxy groups of the polymer and (ii) convert the substituted ammonium carboxylate ionic bonds to amide linkages.

The cure conditions required to achieve optimal cross-linking depends upon several factors, including the particular polymer employed. For example, the cure temperature will depend on the polymer. If the copolymer is a partially neutralized ethylene/maleic anhydride copolymer, a cure temperature of at least 140° C. will be required to achieve cross-linking. If the copolymer is a partially neutralized styrene/maleic anhydride copolymer, a temperature of at least about 150° C. is required to cross-link; and if a partially neutralized isobutylene/maleic anhydride copolymer is employed, a temperature of at least about 170° C. will be required to achieve cross-linking. Cure times can vary depending, of course, on cure temperature and on the amount of reactive compound used. Cure times will typically be within the range of from about 0.5 to about 20 minutes, preferably 0.5 to 15 minutes, and most preferably 0.5 to 12 minutes. To maximize absorbent properties, optimal cure of the fibers (i.e., minimal amount of cross-linking needed to form a cross-linked network) is required. Optimal cure is achieved by adjusting a number of variables within wide ranges depending upon the specific syrup composition. As will be shown in the examples which follow, optimal cure conditions require, among other things, a balance between cure time and cure temperature.

As is readily apparent from the high temperature required to achieve cross-linking, the aqueous reaction product of the partially neutralized polymer and the reactive compound, i.e., the grafted polymer syrup, can be stored for an unlimited time. This unlimited room temperature stability facilitates further processing of the syrup into any number of conventional forms, such as fibers and films using conventional methods. For example, the syrup can be further processed by casting, spray drying, air-assisted spray drying, air attenuation, wet spinning, dry spinning, flash spinning, and the like. To facilitate the removal of water from the aqueous composition of this invention during the spinning process, minor amounts of other polar solvents such as alcohol can be added to the aqueous syrups of the invention. The resultant fibers can be further processed into milled fibers, chopped fibers, fluff or bulk fibers, strands, yarns, webs, composites, woven fabrics, non-woven mats, tapes, scrim, and the like, using a variety of methods including twisting, beaming, slashing, warping, quilling, severing, crimping, texturizing, weaving, knitting, braiding, etc., and the like.

All fiber samples produced in the examples which follow were tested to determine their absorbent properties using conventional test procedures to measure the unit of liquid (brine) absorbed per unit of fiber sample (Free Swell Index) and the unit of liquid (brine) retained per unit of fiber sample after subjecting the swelled fiber sample to 0.5 psi. In addition, all fiber samples were felt after cure to determine whether each sample was slippery to the touch (S) indicating undercure, dry to the touch (D) indicating full cure, or very dry to the touch (VD) indicating overcure. The Free Swell Index test procedure used is described in U.S. Pat. No. 4,454,055, the teachings of which are incorporated herein by reference. The test procedure and equipment used herein were modified slightly as compared to the procedure and equipment described in U.S. Pat. No. 4,454,055.

To determine the Free Swell Index at atmospheric (room) pressure, about 0.2 to 0.3 g of about ¾ in. cured water-absorbing fibers to be tested is placed in an empty W-shaped tea bag. The tea bag containing the fibers is immersed in brine (0.9 wt. % NaCl) for 10 minutes, removed and allowed to sit on a paper towel for 30 seconds to remove surface brine. The Free Swell Index of the fiber, that is, the units of liquid absorbed per each unit of sample is calculated using the following formula:

$$\text{Swell Index} = \frac{\text{Weight of Wet Fibers}}{\text{Weight of Dry Fibers}} - 1$$

To determine Free Swell Index under pressure (0.5 psi retention), the following modified procedure was used.

After the tea bag containing the fiber sample is immersed in brine and surface brine is removed, it is immediately placed in a 16 cm ID Buchner funnel fitted with a 2000 ml sidearm vacuum filter flask and connected to a manometer. A piece of dental dam rubber sheeting is securely fixed over the mouth of the funnel such that the sheeting just rests on the tea bag. Next, a vacuum sufficient to create the desired pressure is drawn on the flask for a period of 5 minutes, and the Free Swell Index under pressure is calculated using the above formula.

The following examples further demonstrate the invention.

EXAMPLE 1

This example demonstrates the preparation of an uncured syrup composition of this invention and further demonstrates the preparation of cured absorbent fibers from the syrup composition.

A syrup composition (Syrup A) was prepared by reacting about 2.96 grams (2 phr) of a water-soluble reactive compound, tris(hydroxymethyl)aminomethane, with about 400 grams of a partially neutralized isobutylene/maleic anhydride copolymer solution. The partially neutralized isobutylene/maleic anhydride copolymer solution was prepared as follows.

About 148.2 lbs. of demineralized water were added to a 50-gallon Ross mixer. Next, about 31 lbs. of sodium hydroxide pellets were added slowly to the mixer with agitation. About 108.5 lbs of ISOBAM-10 isobutylene/maleic anhydride (1:1) copolymer were charged into the mixer over a period of about one hour with agitation. ISOBAM-10 copolymer has a viscosity molecular weight of about 170,000 and is commercially available from Kuraray Isoprene Chemical Company, Ltd. After the addition of ISOBAM-10 copolymer, the mixer contents were heated to about 100° C. and held with continuous agitation for about four hours to complete the neutralization reaction.

Syrup A was observed to be non-cross-linked and found to be stable at room temperature. Syrup A was also found to contain 48% solids and have a pH of 6.8. The degree of neutralization was found to be about 0.55, meaning 55% of carboxyl groups had been neutralized, with 45% remaining unneutralized carboxylic acid units.

Fibers were spun from Syrup A using a dry spinning process. The fibers produced had deniers of 2–3 and were non-cross-linked.

The fibers were divided into several portions and each portion was separately cured by heating at about 180° C. for different cure times within the range of from about 10 to about 20 minutes. Each portion of cured fibers was recovered as water-absorbing fibers of the invention and tested for brine absorbency. The cure conditions and brine absorbency test results are shown in Table I.

TABLE I

| FIBER CURE CONDITIONS AND BRINE ABSORBENCY PROPERTIES | | | | | |
|---|---|---|---|---|---|
| Fibers of Syrup | A | A | A | A | A |
| Cure Temperature (°C.) | 180 | 180 | 180 | 180 | 180 |
| Cure Time (Minutes) | 10 | 10 | 14 | 18 | 20 |
| Absorbency Test: | | | | | |
| Swell Index | | | | | |
| Atm. Pressure (g/g) | 100.5 | 95.6 | 80.6 | 76.5 | 69.9 |
| 0.5 psi (g/g) | 72.5 | 66.6 | 55.6 | 48.9 | 42.6 |
| Cure State | D | D | D | D | D/VD |

The above data show that using 2 phr of reactive compound and a cure temperature of 180° C. fully cured fibers having excellent absorbency are produced. The data further show that absorbent properties decrease as cure times are lengthened, indicating that cure times of about 10 minutes or less at 180° C. and 2 phr cross-linking agent are optimal.

EXAMPLE 2

This example demonstrates the preparation of another uncured syrup composition of this invention (Syrup B) using substantially the procedure of Example 1 but employing 5.92 grams (4 phr) of tris(hydroxymethyl)aminomethane reactive compound.

Syrup B was likewise observed to be non-cross-linked and found to be stable at room temperature.

Fibers of 2–3 denier were spun from Syrup B using a dry spinning process. The uncured fibers were divided into several portions for curing, and each portion was cured and tested to determine its absorbent properties. The cure conditions and brine absorbent properties are shown in following Table II.

TABLE II

| FIBER CURE CONDITIONS AND BRINE ABSORBENT PROPERTIES | | | | | | | |
|---|---|---|---|---|---|---|---|
| Fibers of Syrup | B | B | B | B | B | B | B |
| Cure Temperature (°C.) | 180 | 185 | 180 | 185 | 180 | 180 | 180 |
| Cure Time (Minutes) | 5 | 5 | 7.5 | 7.5 | 8.7 | 10 | 15 |
| Absorbency Test: | | | | | | | |
| Swell Index | | | | | | | |
| Atm. Pressure (g/g) | 85.7 | 67.3 | 79.7 | 51.7 | 69.9 | 63.8 | 57.5 |
| 0.5 psi (g/g) | 49.6 | 45.9 | 44.8 | 41.0 | 43.7 | 40.3 | 37.0 |
| Cure State | D | D | D | D | D | VD | VD |

The above data show that using 4 phr of reactive compound and a cure temperature of from 180°–185° C. that fully cured fibers possessing excellent absorbent properties result. Because the absorbency properties using 4 phr of reactive compound are not as good as the absorbency achieved using 2 phr (see Table I), less than 4 phr cross-linking agent is preferred at a cure temperature of 180° C. and a cure time of about 10 minutes. The data further show that if 4 phr of reactive compound is used, cure times of less than 10 minutes are required to achieve optimal absorbency.

EXAMPLE 3

This example demonstrates the preparation of another syrup composition of the invention (Syrup C) using substantially the procedure of Example 1 but employing ISOBAM-18 rather than ISOBAM-10 copolymer. ISOBAM-18 has a higher viscosity molecular weight of from 290,000 to 310,000.

Syrup C was observed to be non-cross-linked and found to be stable at room temperature.

Fibers of 2–3 denier were spun from Syrup C by a dry spinning process. The effect of different cure temperatures and times on the absorbent properties of three pairs (same cure times) of fiber samples is shown in Table III.

TABLE III

| FIBER CURE CONDITIONS AND BRINE ABSORBENT PROPERTIES | | | | | | |
|---|---|---|---|---|---|---|
| Fibers of Syrup | C | C | C | C | C | C |
| Cure Temperature (°C.) | 174 | 178 | 174 | 178 | 174 | 178 |
| Cure Time (Minutes) | 4 | 4 | 6 | 6 | 8 | 8 |
| Absorbency Test: | | | | | | |
| Swell Index | | | | | | |
| Atm. Pressure (g/g) | 74.7 | 118.8 | 126.9 | 122.5 | 118.5 | 96.0 |
| 0.5 psi (g/g) | 44.2 | 68.7 | 80.2 | 71.8 | 71.8 | 63.7 |
| Cure State | S | S/D | D | D | D | D |

The above data show the sensitivity of fiber absorbent properties to cure conditions. Although all of the six fiber samples were found to possess excellent absorbent properties, the data show that for Syrup C, the optimal conditions to be a cure time of about 6 minutes at a cure temperature of from 174°–178° C. The samples which were cured for only 4 minutes were deemed to be slippery to the touch (S) and, hence, undercured.

EXAMPLE 4

Using the above-described procedures, three additional syrup compositions (Syrups D, E, and F) were prepared using different reactive compounds. Table IV sets forth the compositions of Syrups D, E, and F and the cure conditions and brine absorbent properties of the 2–3 denier fibers prepared from each syrup.

TABLE IV

| SYRUP COMPOSITION, FIBER CURE CONDITIONS, AND BRINE ABSORBENT PROPERTIES | | | |
|---|---|---|---|
| Syrup Composition | D | E | F |
| Copolymer: | | | |
| Neutralized copolymer of Example 1 | 100 | 100 | — |
| Neutralized copolymer of Example 3 | — | — | 100 |
| Reactive Compound: | | | |
| Ethanolamine (phr) | 3 | 2 | — |
| DL-1-amino-2-propanol (phr) | — | — | 4 |
| Fiber Cure Conditions: | | | |
| Cure Temperature (°C.) | 180 | 180 | 180 |
| Cure Time (Minutes) | 4 | 6 | 6 |
| Fiber Absorbency Test: | | | |
| Swell Index | | | |
| Atm. Pressure (g/g) | 95.0 | 70.7 | 93.0 |
| 0.5 psi (g/g) | 77.3 | 51.9 | 53.8 |

The above data show that excellent absorbency is achieved using various reactive compounds which contain one amine and at least one hydroxyl group.

It will be evident from the foregoing that various modifications can be made to this invention. Such, however, are considered as being within the scope of the invention.

What is claimed is:

1. A fiberizable, aqueous, uncured but curable, polymer composition comprising the reaction product of:

(a) a partially neutralized aqueous polymer composition prepared by the reaction of a strong base with a polymer containing at least 25 mole percent recurring units of an $\alpha,\beta$-unsaturated monomer having in its molecule one or two carboxyl groups or one or two other groups convertible to and converted to carboxyl groups, the degree of neutralization of said partially neutralized polymer being within the range of from about 0.2 to about 0.8 equivalent of total carboxyl groups of the $\alpha,\beta$-unsaturated monomer, with (b) from about 0.1 to about 10 total parts by weight of at least one reactive compound per 100 parts by weight of the partially neutralized aqueous polymer composition, the reactive compound being a water soluble compound bearing one amine group and at least one hydroxyl group, wherein the reaction product is formed by an ionic bonding reaction between the unneutralized carboxyl groups on the polymer and the amine groups on the reactive compound, and is stable at room temperature and can be made into absorbent fibers.

2. The fiberizable composition of claim 1 in which said polymer is a copolymer containing from about 25 to about 75 mole percent recurring units of at least one $\alpha,\beta$-unsaturated monomer having in its molecule one or two carboxyl groups or one or two other groups convertible to and converted to carboxyl groups and from about 75 to about 25 mole percent recurring units of at least one copolymerizable monomer.

3. The fiberizable composition of claim 1 in which said polymer is a copolymer containing from about 35 to about 65 mole percent recurring units of at least one $\alpha,\beta$-unsaturated monomer having in its molecule one or two carboxyl groups or one or two other groups convertible to and converted to carboxyl groups and from about 65 to about 35 mole percent recurring units of at least one copolymerizable monomer.

4. The fiberizable composition of claim 1 in which said polymer is a copolymer containing about 50 mole percent recurring units of at least one $\alpha,\beta$-unsaturated monomer having in its molecule one or two carboxyl groups or one or two other groups convertible to and converted to carboxyl groups and about 50 mole percent recurring units of at least one copolymerizable monomer.

5. The fiberizable composition of claim 1 in which said polymer is a copolymer selected from the group consisting of $\alpha$-olefin/maleic anhydride copolymer, $\alpha$-olefin/citraconic anhydride copolymers, $\alpha$-olefin/acrylic acid copolymers, $\alpha$-olefin/methacrylic acid copolymers, vinyl compound/maleic anhydride copolymers, vinyl compound/citraconic anhydride copolymers, vinyl compound/acrylic acid copolymers, vinyl compound methacrylic acid copolymers, alkyl acrylate/maleic anhydride copolymers, alkyl acrylate/citraconic anhydride copolymers, alkyl vinyl ether/maleic anhydride copolymers, alkyl vinyl ether/citraconic anhydride copolymers, $\alpha$-olefin/maleic anhydride/$\alpha$-olefin terpolymers, and vinyl acetate/maleic anhydride copolymers.

6. The fiberizable composition of claim 1 in which said polymer is polyacrylic acid.

7. The fiberizable composition of claim 1 in which said polymer is polymethacrylic acid.

8. The fiberizable composition of claim 1 in which said polymer is isobutylene/maleic anhydride copolymer.

9. The fiberizable composition of claim 1 in which said copolymer is isobutylene/maleic anhydride/styrene terpolymer.

10. The fiberizable composition of claim 1 in which said polymer is a styrene/maleic anhydride copolymer.

11. The fiberizable composition of claim 1 in which said at least one reactive compound is present in an amount of from about 0.5 to about 6 total parts by weight.

12. The fiberizable composition of claim 1 in which said at least one reactive compound is present in an amount of from about 1 to about 5 total parts by weight.

13. The fiberizable composition of claim 1 in which said reactive compound is ethanolamine.

14. The fiberizable composition of claim 1 in which said reactive compound is tris(hydroxymethyl-)aminomethane.

15. The fiberizable composition of claim 1 in which said reactive compound is 3-amino-1-propanol.

16. The fiberizable composition of claim 1 in which said reactive compound is DL-1-amino-2-propanol.

17. The fiberizable composition of claim 1 in which said reactive compound is 2-amino-1-butanol.

18. The fiberizable composition of claim 1 in which said reactive compound is N-N-dimethylethanolamine.

19. The fiberizable composition of claim 1 in which said reactive compound is diisopropanolamine.

20. The fiberizable composition of claim 1 in which said reactive compound is methyldiethanolamine.

21. The fiberizable composition of claim 1 in which said reactive compound is triethanolamine.

22. The fiberizable composition of claim 1 in which said reactive compound is 2-(methylamino)ethanol.

* * * * *